United States Patent [19]

Langman et al.

[11] 4,424,935

[45] Jan. 10, 1984

[54] SPRING RAIL FASTENER

[75] Inventors: William F. Langman, Belair; Leslie J. Diener, Torrens Park; Jack Clark, Reynella, all of Australia

[73] Assignee: Omark Industries, Inc., Portland, Oreg.

[21] Appl. No.: 173,917

[22] Filed: Jul. 31, 1980

Related U.S. Application Data

[63] Continuation-in-part of Ser. No. 28,216, Apr. 9, 1979, abandoned.

[30] Foreign Application Priority Data

| | | | |
|---|---|---|---|
| Apr. 14, 1978 | [AU] | Australia | PD4031 |
| Jun. 1, 1978 | [AU] | Australia | PD4572 |
| Mar. 28, 1979 | [AU] | Australia | 45550 |

[51] Int. Cl.[3] ..... E01B 9/34; E01B 9/48; E01B 29/24

[52] U.S. Cl. ..... 238/349; 238/351; 238/354; 238/361

[58] Field of Search ..... 238/21, 206, 207, 208, 238/253, 266, 267, 324, 340, 351, 353, 354, 361, 362, 363, 364, 365, 349

[56] References Cited

U.S. PATENT DOCUMENTS

| | | | |
|---|---|---|---|
| 1,422,340 | 7/1922 | Cooper et al. | 238/349 |
| 1,839,725 | 1/1932 | Armstrong | 238/349 |
| 1,976,069 | 10/1934 | Hartman | 238/324 |
| 1,998,043 | 4/1935 | Boyd et al. | 238/354 |
| 2,203,624 | 6/1940 | Clarkson | 238/349 |
| 2,324,134 | 7/1943 | Chidester | 238/349 |
| 2,480,388 | 8/1949 | Sonneville | 238/349 |
| 2,535,337 | 12/1950 | Wertz | 238/349 |
| 3,550,851 | 12/1970 | Sonneville | 238/349 |
| 3,831,842 | 8/1974 | Tamura | 238/349 |
| 4,254,909 | 3/1981 | Rex | 238/349 |

FOREIGN PATENT DOCUMENTS

| | | | |
|---|---|---|---|
| 2438480 | 2/1975 | Fed. Rep. of Germany | 238/349 |
| 2554657 | 6/1976 | Fed. Rep. of Germany | 238/340 |
| 1434560 | 5/1976 | United Kingdom | 238/349 |

*Primary Examiner*—Bruce H. Stoner, Jr.
*Assistant Examiner*—Howard Beltran
*Attorney, Agent, or Firm*—Duffield & Lehrer

[57] ABSTRACT

A resilient rail fastener having a clip having a lower leg with a toe at one end and a heel at the other, an upstanding back portion between the heel and an upper leg, and a rectangular locating aperture in at least one of its legs which engages over a rectangular retaining block. The retaining block has pressure imparting means projecting from each side and bearing downwardly on the upper leg of the clip and thereby applies a downward pressure at each end of the lower leg. One end of the lower leg bears downwardly on the rail support and the other end on the rail to impart a toe pressure. The reduced cross-sectional area of the clip where it passes over the retaining block causes high stresses in the legs of the clip as well as at the locality of the clip heel, and the upstanding back portion has less stress than a hairpin clip, and this results in a lower spring rate for the toe clip so that toe pressure is retained upon rail settlement, and stress corrosion is reduced.

8 Claims, 10 Drawing Figures

SPRING RAIL FASTENER

The present application is a continuation-in-part of application Ser. No. 028,216, filed Apr. 9, 1979, now abandoned.

This invention relates to a rail fastener which is usable for fastening a rail to a base plate or sleeper.

BACKGROUND OF THE INVENTION

Fastening clips formed from spring steel plate are already known, and in the U.S. Pat. No. 3,831,842 (Tamura) there was described and illustrated a rail fastening clip of general U-shape or "hairpin" shape. In that specification the resilience however, which imparted toe pressure to the rail was due to pressure applied between the ends of the upper leaf of the U-shaped spring, the lower leaf being utilised to locate the rail edge, and in some instances apply no pressure at all. If the required toe pressure on the rail foot is achieved with only a small amount of deflection (due to the effective strained portion being short in length), then a small degree of "settling" of a rail will result in excessive loss of toe pressure. This is of importance when resilient pads are used, since such pads are subject to plastic flow over a period of time. It can be shown that the Tamura device necessarily has a relatively small deflection for the required toe pressure. Furthermore, the sign of the bending moment in the Tamura clip reverses intermediate its ends (that is, the outer fibres pass from tension to compression) between the heel of the clip and the holding down bolt, and this necessarily results in loss of efficiency, having regard to the volume of metal in the clip.

A series of studies has indicated that it is usually desirable to have a toe pressure of between 4000 and 5000 pounds applied to a rail foot, that is, between 2000 pounds and 2500 pounds by each fastener, and the main problem which is encountered when flat or nearly flat plates are used (for example as shown in Boyd U.S. Pat. No. 1,998,043) is again that there is but a small amount of deflection which can be imparted to a plate of feasible length to achieve the required loading.

Screw threaded locking members, such as the bolts illustrated in said U.S. Pat. No. 3,831,842 are generally disfavoured by railway engineers because of the likelihood of failure of the means used to prevent the bolts unscrewing, and probability of thread damage. Consequently, the wedge type locking pin as illustrated in said U.S. Pat. No. 1,998,043 is preferred in some instances, but a difficulty is encountered in possible error due to the manufacturing tolerances required to produce the interengaging parts. The sum total of tolerance errors can often represent a relatively large proportion of the total deflection required for deflecting the plates intermediate their ends, and it becomes very difficult to ensure that the toe pressure against the rail foot always lies within the required working range.

One of the objects of this invention therefore, is to provide improvements whereby the deflection of a rail fastener clip is much greater than heretofore, without producing a clip so long and unwieldly as to be impractical. Briefly, this is achieved in two ways in this invention. First of all a rail fastener clip has a lower leg, an upper leg, and an upstanding back portion joining the legs, and is arranged to have a heel (or toe) bear against a tie or base plate, a toe (or heel), or a pair of toes bear up against the upper surface of the rail foot, and a deflection finger or a pair of deflection fingers on an upper return portion of the fastener clip which are deflected downwardly. Thus the additional length of the plate becomes available for strain, thereby increasing the amount of deflection for a given toe load over that which has been used in prior art clips. A second factor which assists in achieving a large range of deflection for the required range of toe pressure (that is, a low spring "rate") is introducing a variation in cross-sectional area of the clip over its length so that there is a high stress, not only at the locality of the clip heel, but also in each of the legs. This is achieved by having a locating aperture extending through one of the legs, and can also be further implemented by having a pair of deflection fingers forming a bifurcate end to the clip, and a pair of clip engaging toes at the other end, again forming the end to a bifurcate shape. Ideally of course, the edge configuration should be so contoured that the stress is constant throughout the entire length of the clip, but with the arrangement described the improvement is so great that there is in practice no need to incur the expense of fully contouring the clip edges.

If a clip is formed to a "hair-pin" shape, as for example in the U.S. specifications of Armstrong (1,839,725) or Cooper et al (1,422,340), the maximum stress occurs at the extremity of the clip, and this progressively reduces away from that one locality. A further factor which assists in achieving a low spring rate in this invention is the use of an upstanding, back portion between the heel of the clip and the upper leg of the clip (a "straight back"). By having a minimum of curvature in the back portion of the clip, there is a minimum of variation of bending moment over that portion, and therefore better use is made of the available spring metal. Not only does this improve the spring rate of the clip, it also reduces the maximum stress in the clip when it is strained downwardly, and this is of major importance when the clip is used under conditions of high stress corrosion.

In one embodiment which was tested, the working range of toe load of 1500 to 2250 pounds was found to be caused by a deflection of between 4 and 6 mm. imparted to the deflection fingers. This compares very favourably with prior art devices, and provides a range which is easily achieved with ordinary manufacturing tolerances.

Most rail fastening clips presently in use are likely to become displaced upon rail creep in a longitudinal direction, due for example to differential expansion or contraction of the rail with respect to its supporting substrate, or by other causes such as dynamic effects, caused by the passage of trains over the rails. Another object of this invention is to provide fastening means which will inhibit movement of the clip even when rail creep takes place. This is achieved by having a rectangular locating block extending upwardly from a rail support and extending through a rectangular locating aperture in the rail clip, which inhibits both relative rotational and translational movement of the clip.

BRIEF SUMMARY OF THE INVENTION

Briefly, in this invention, a resilient rail fastener comprises a clip with a lower leg with a toe at one end and a heel at the other, an upstanding back portion between the heel and an upper leg, a rectangular locating aperture in at least one of its legs which engages over a rectangular retaining block. The retaining block has a retaining pin extending through it to project from each side and bear downwardly on the upper leg of the clip and thereby apply a downward pressure at each end of the lower leg. One end of the lower leg bears downwardly on the rail support and the other end on the rail to impart a toe pressure. The reduced cross-sectional area of the clip where it passes over the retaining block causes high stresses in the legs of the clip as well as at the locality of the upstanding back portion, and this results in lower stresses and a lower spring rate for the toe clip so that toe pressure is not lost upon rail settlement.

More specifically, the invention consists of a rail fastener for fastening a rail to a rail support which comprises a retaining block upstanding from the rail support, and a pressure imparting pin extending from the block in the same direction as the longitudinal direction of the rail, a resilient fastener clip having an upper leg, a lower leg with at least one toe at one end, a heel at the other end, and an upstanding back portion joining the heel to the upper leg, the fastener clip having edges which engage against side walls of said retaining block thereby locating the fastener clip with respect to the retaining block to inhibit translational movement, the retaining block pressure imparting pin bearing downwardly on the upper said leg to thereby strain the clip and apply a downward pressure at each of said ends, respectively against the rail foot and the rail support.

If a heavily loaded train traverses a curve, or is subject to buckling due, for example, to dynamic braking forces, the rail head must resist high lateral forces. In extreme cases, these forces can overturn a rail, and further in this invention there is provided means to inhibit such rail overturn, in that the upper leg of the clip overlies the lower leg thereof and is closely adjacent thereto, such that the lower leg can move in accordance with the spring rate during initial lifting of the rail foot until the legs become contiguous, thereby preserving the design resilience of the track for a first stage of rail foot lift. A second stage of rail foot lift commences however, when the legs become contiguous, in that a short projecting end of the top leg is caused to bend, and the spring rate sharply increases, allowing only a very small deflection for a very large increase in pressure, and this inhibits rail overturn.

This rapid increase in spring rate has further advantages:

A second advantage is protection of the fastening assembly if a ballast tamping machine is incorrectly operated and bears downwardly on the sleeper while an upward force is applied to the rail. Without the increase in spring rate, the clip can be strained beyond its elastic limit, with consequential loss of toe pressure, and in some designs of clip, the clip can work loose.

A third advantage, also associated with tamping and certain other track maintenance operations, is that the increase in spring rate when the legs become contiguous limits the amount of separation between the rail and supporting pad (when used), and thereby limits access of foreign material (dust, metal particles and the like) which otherwise cause rapid deterioration of the pad.

A still further advantage of the two stage resilience relates to resilience of elastic damping pads between rails and sleepers. It has been well established that load distribution between various track components can be varied advantageously by the provision of elastic damping pads between rails and sleepers. The flexibility required is such that the requirements to limit gauge widening due to rail rotation are significant and introduce practical difficulties. For the solution of the problem there is an established optimum relationship between the elasticity of the pad and that of the clip when deflection is such that it becomes necessary to limit rail rotation, and that optimum relationship is not readily achieved during the first stage of clip deflection, which is associated with relatively low toe pressures. However, by this invention, it is possible to arrange the second stage of deflection, associated with the high spring rate, to satisfy that optimum relationship (which is in the order of 1 to 10 ratio of the spring rate of the clip with respect to the elasticity of the pad).

With this invention, a rail support has two retaining blocks upstanding from it, one on each side of a rail. These are best secured by a stud welding process. However, conditions may arise under which a bearing edge of the rail fastener which bears against a rail foot needs to have a different location. This can occur when the size of the rail is changed, or when it is required to "close up" gauge when the rails have worn, or when it is required to accommodate a fish plate joining the rails.

Further in this invention, the legs of the clip are of unequal length, and each respective toe end of the legs is bifurcate, and has a deformed portion which defines a bearing edge, the bearing edge of the lower leg bearing against the rail foot, such that upon inverting the clip, the location of the bearing edge of the lower leg is varied.

BRIEF DESCRIPTION OF THE DRAWINGS

Still further features of the invention are disclosed hereunder in embodiments of the invention which are described with reference to, and are illustrated in, the accompanying drawings, in which.

DETAILED DESCRIPTION OF INVENTION

Figure 1:
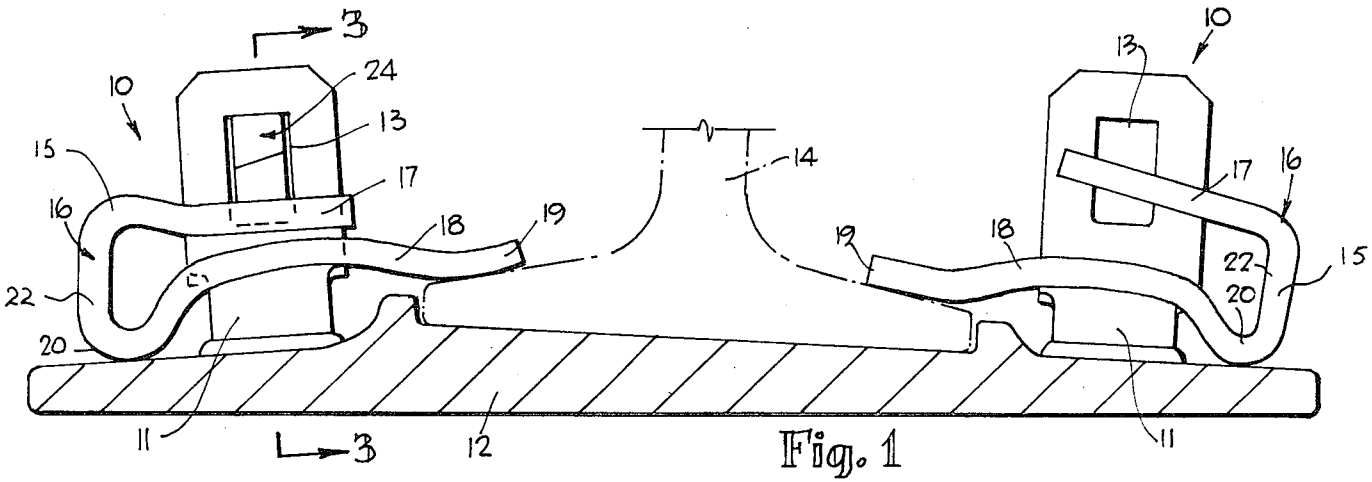
FIG. 1 is a cross-section through a rail supported by a base plate, showing two rail fastener clips, one of which is shown in an unstrained condition, and the other in a strained condition, and bearing down on a rail foot.
Figure 2:
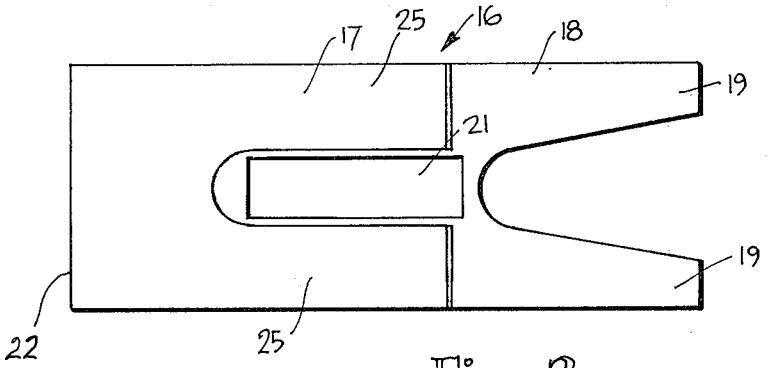
FIG. 2 is a plan view of a rail clip.

Reference is made to the first embodiment of FIGS. 1 2, 3 and 4. In this embodiment, a rail fastener 10 comprises a rectangular retaining block 11, stud welded to a base plate 12, which constitutes a rail support, and is upstanding therefrom. The retaining block 11 has a retaining pin aperture 13 therein, the aperture being defined by walls which extend in the longitudinal direction of the rail 14.

A resilient fastener clip 16 is formed from rectangular section spring steel to the shape as shown on the right hand side of FIG. 1, and has an upper leg 17, a lower leg 18 which has two toes 19 at one end, being bifurcate at that end. A heel 20 is formed as a curved portion at one end of the lower leg 18, and the upper leg 17 is also formed with a heel 15 having a curved portion. A straight back portion 22 separates the heels of the legs 17 and 18. The fastener clip also has a rectangular locating aperture 21 extending through its lower leg 18, and the retaining block 11 extends through the aperture 21 as shown best in FIG. 3. Both the block 11 and the aperture 21 are rectangular in shape, and this then inhibits any relative rotational movement as well as any relative translational movement between the lower leg 18 and the base plate 12.

The configuration of the two heels 15 and 20 and their interconnection with the back portion 22 of the fastener clip 16 is such that the upper leg 17 is inclined upwardly in a diverging angle upwardly and away from the lower leg 18, as best seen in FIG. 1. In this manner the upper leg 17, when in the relaxed position as shown in the right hand portion of FIG. 1, will be positioned above at an angle inclined to the side walls of the aperture 13 and positioned above the bottom wall of the aperture 13. This disposition of the upper leg 17 of the clip 16 provides the interference fit with a retaining pin 24, to be described in detail hereinafter, in order that a resilent downward pressure may be applied to the upper and lower legs 17 and 18 respectively and to the toe 19 when the retaining pin 24 is in position as shown in the left hand portion of FIG. 1.

Figure 3:
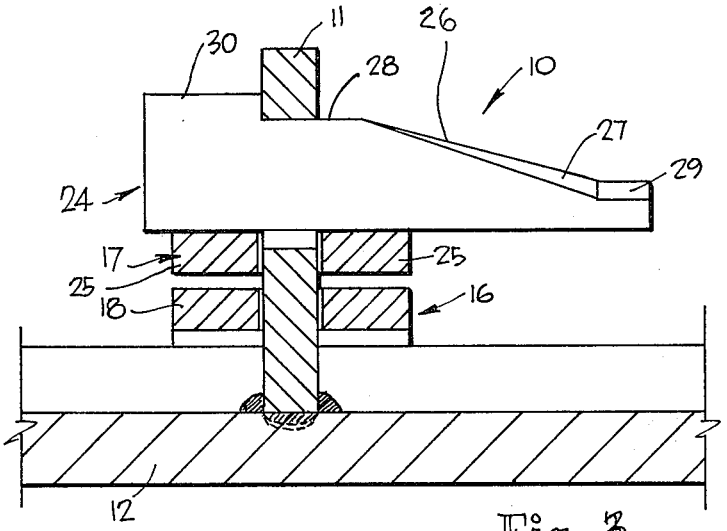
FIG. 3 is a section on line 3—3 of FIG. 1.
Figure 4:
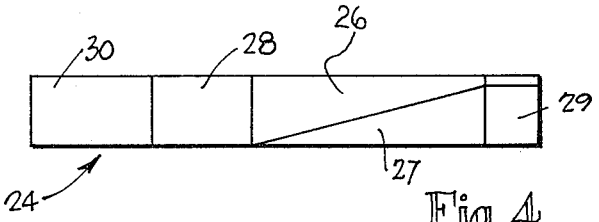
FIG. 4 is a plan view of a retaining pin.

A retaining pin 24, to be described in more detail hereinafter, extends through the retaining pin aperture 13, and bears downwardly on the two fingers 25 (as shown in FIG. 3) to thereby apply a downward pressure at the toes 19 and heel 20 (FIG. 1), respectively against the base plate 12 and the foot of the rail 14.

It will be noted that both the upper and lower legs are bifurcated, and also that the lower leg contains the locating aperture 21 therein, so that the legs strain under the stress imposed by the retaining pin 24 to some extent, thereby reducing the "rate" of the spring, and causing a relatively large deflection of the fastener clip 16 from the shape shown on the right hand side of FIG. 1 to the shape shown on the left hand side of FIG. 1, to achieve the required toe pressure. Any settlement of the rail 14 with respect to the base plate 12 (which can take place if insulating pads are used) will therefore not result in very much loss of toe pressure, and the toe pressure will be retained within acceptable limits for all likely settlement.

Further it will be noted that when the upper leg 17 has been strained downwardly by the retaining pin 24, it lies very close to the lower leg 18. Thus in the event of the pressure on the head of the rail being so great that the rail tends to overturn, the initial movement of the toes 19 will be relatively small, whereupon the lower leg 18 will become contiguous with the upper leg 17 and much of the resilience of the rail fastener 10 will be lost, the rail fastener 10 then becoming very stiff and resisting further upward displacement of the toes 19 with a second stage of spring rate.

Figure 9:
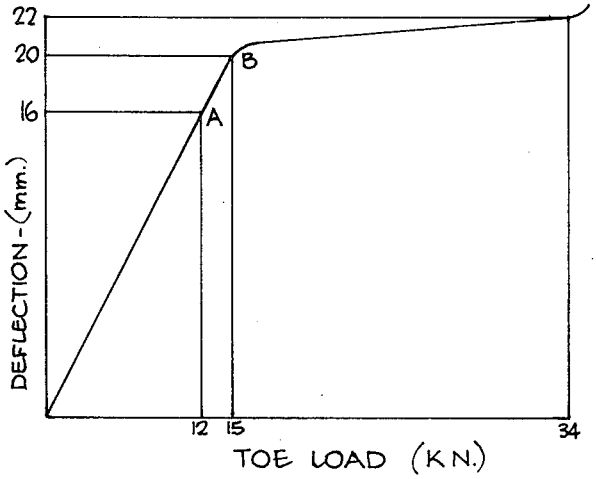
FIG. 9 is a load/deflection diagram which illustrates the two stage spring rate.
Figure 8:
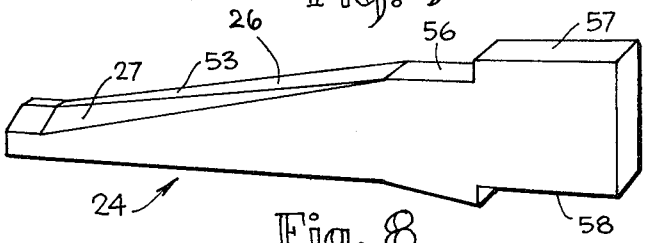
FIG. 8 is a perspective view of an alternative form of retaining pin, having "vandal-proof" characteristics.

FIG. 9 clearly shows the two effective spring rates. The initial deflection of the fastener clip 16 is 16 mm. and this is associated with a toe pressure of 12 kN (Kilo Newton) illustrated by point A on the load/deflection curve. A further 4 mm. of deflection can take place to point B on the curve, and the toe load will increase to 15 kN. This is the primary range of deflection and is related to the design resilience of the track. At point B the legs become contiguous, and a further 2 mm. deflection takes place at point C, and is associated with a toe load of 34 kN. One kN converts to approximately 225 pounds. This secondary spring rate is advantageously about one tenth of the spring rate of the resilient pad between the rail and the sleeper.

Figure 10:
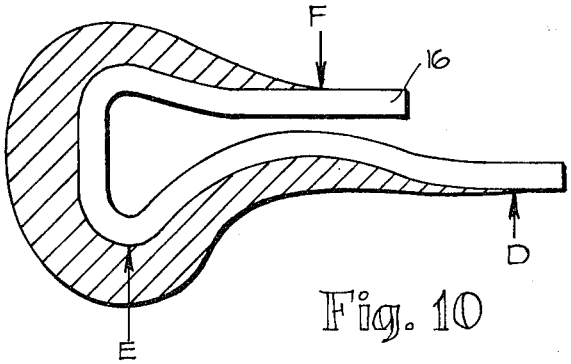
FIG. 10 is a loading diagram of the bending moment applied to the fastener clip of FIG. 1.

FIG. 10 illustrates a loading diagram superimposed on the clip where the bending moment exists between point F (where the retaining pin bears downwardly on the upper leg), and the toe at D. The point E designates the heel of the clip. It will be noted that the bending moment is continuous, that is, there is no change of sign, and that the outer fibre of the clip is continuously in tension between points F and D. Further, it will be noted that at the localities of the bifurcate ends, and the locating aperture 21, where the cross-section of the clip is small, the bending moment is also small. The bending moment along the straight back of the clip varies to only a small extent, and the stress in that portion is therefore low, and this also contributes to the low spring rate.

Since the clip 16 is restrained from rotational or translational movement by the retaining block 11, any rail creep which occurs under conditions of extreme cold or extreme heat will be without dislodgement of the clip, and this is very valuable in certain instances.

When the retaining pin is driven into the pin aperture 13, as shown on the right hand side of FIG. 1, the pin will be first tilted by the sloping upper face of the upper leg 17, and the pin 24 has a wedge portion 26 provided with a transversely slanting surface designated 27, and a flat land 28 at the upper end of the slanting surface 27. The lower end of the wedge portion 26 has a short portion which slopes only transversely, being a lead-in portion and designated 29 but the remainder of the slanting surface 27, where it rises along the wedge portion, slopes both longitudinally and transversely. The head end 30 of the retaining pin 24 extends upwardly a short distance above the land 28 and is arranged to be driven in by hammer blows or by a leverage or hydraulic tool. When the retaining pin is driven into the pin aperture, the transversely slanting surface 27 engages the upper wall of the pin aperture, without damaging its surface. The pin gradually resumes a vertical position as its side walls engage the side walls of the pin aperture, and the ramp portion depresses the upper leg.

In the above embodiment, the retaining block 11 has been shown displaced to one side of the edge of the foot of the rail 14. However, if the block is utilised along with a steel sleeper for example, the block 11 can easily be welded into a correct position for locating the rail and thereby holding rail gauge. This feature is not herein illustrated.

Figure 5:
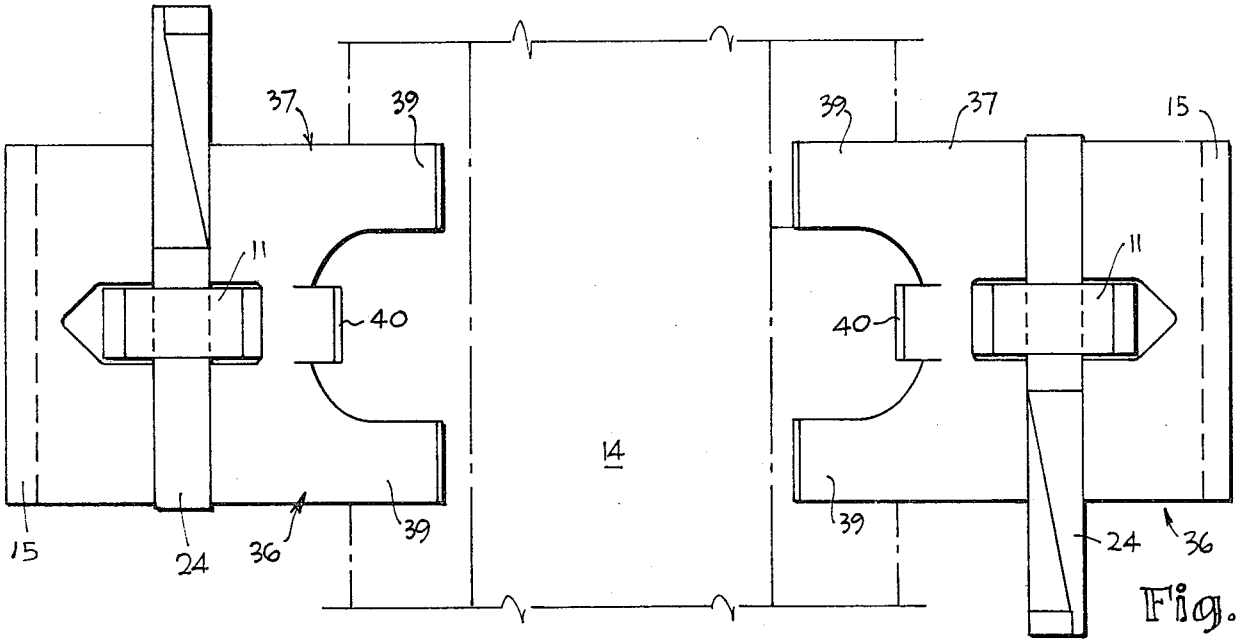
FIG. 5 is a fragmentary plan view showing a rail and fastener assembly according to a second embodiment.
Figure 6:
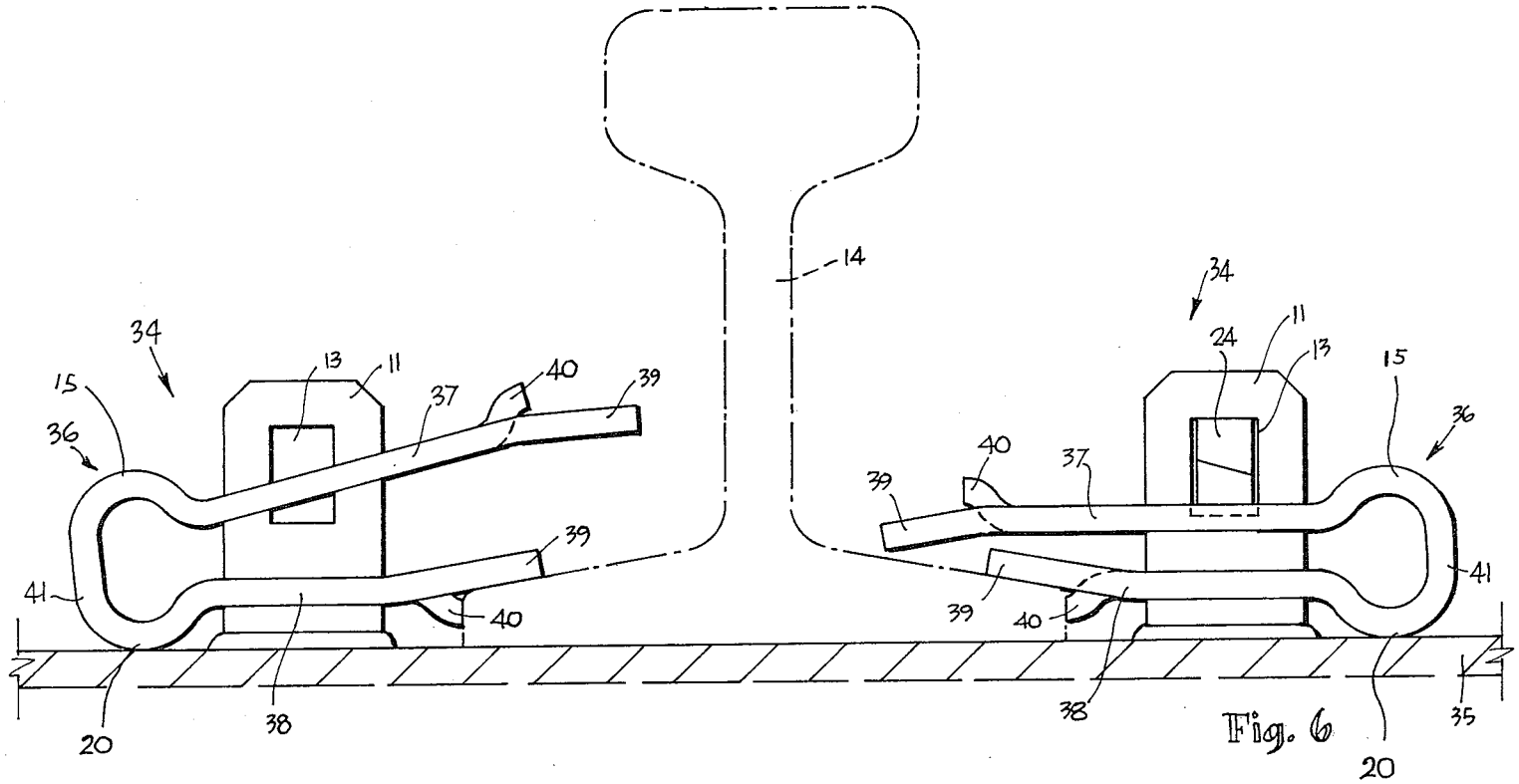
FIG. 6 is a cross-section of FIG. 5, but with one retaining pin removed.

Reference is now made to the second embodiment of FIGS. 5 and 6. The rail fastener 34 includes a retaining block 11 upstanding from a steel sleeper 35 to which it is welded by a stud welding process. The block 11 contains a pin aperture 13 as in the first embodiment, and is positioned a little to one side of the edge of the foot of the rail 14, as in the first embodiment.

However, the fastener clip 36 has two relatively long legs, the upper leg 37 being shown a little longer than the lower leg 38. Each leg is bifurcated, as can be best seen from FIG. 5, to have a pair of toes 39. Inbetween the toes there is provided an outwardly deformed portion 40, which, in the case of the lower leg 38, abuts the edge of the foot of the rail 14 to hold gauge. A heel 20 is formed as a curved portion at one end of the lower leg 38, and the upper leg 37 is also formed with a heel 15 having a curved portion. A straight back portion 41 separates the heels 15 and 20. The angulation of the upper leg 37 to the lower leg 38 and the upper legs relative position to the aperture 13 are the same as in the first embodiment. The retaining pin 24 is of similar shape to that of the first embodiment, and functions in substantially the same way, to apply pressure on the toes 39 of the lower leg 38, and the heel 20, which is driven into engagement with the steel sleeper 35.

In the event that the rail is to be replaced by a lighter rail having a narrower foot, the fastener clip 36 is merely inverted, whereupon the locating edges of the deformed portions 40 are positioned closer to the center line of the rail 14. Alternatively, by utilising a relatively long lower leg on one side and a relatively short lower leg 38 on the other, the rail can be moved across laterally to compensate for wear on the rail head.

Figure 7:
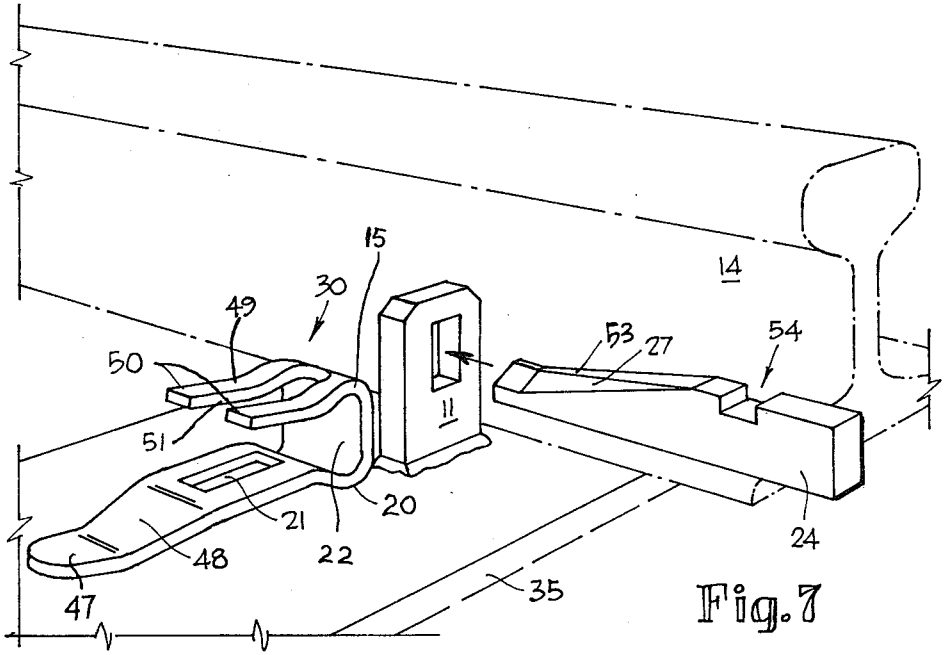
FIG. 7 is an "exploded" perspective view of a fastener assembly according to a third embodiment.

The third embodiment of FIG. 7 is somewhat similar to the first embodiment, and similar items bear similar designations. In the third embodiment of rail fastener, the rail clip 30 has a lower leg 48 terminating in a toe 47 and an upper leg 49. The upper leg 49 includes a slot 51 which defines two fingers 50 of a bifurcated nature. The upper leg 49 and lower leg 48 each respectively extend into an upper heel 15 and a lower heel 20 which curve into and join a straight back portion 22 as in the case of the embodiment of FIGS. 1–3. Likewise the angulation of the lower leg 48 and upper leg 49 and position to the aperture in the retaining block 11 is as in the first embodiment. In the third embodiment, the heel 20 bears against the foot of a rail 14, the toe 47 of the lower leg 48 bears against the steel sleeper 35, and the upper leg 49 is deflected downwardly by the retaining pin 24 which passes through the retaining block 11. In this embodiment, however, the locating aperture 21 is in the lower leg 48 only, and the upper leg 49 is bifurcated to have two fingers 50, the slot 51 having a rounded inner end to avoid the formation of high stresses.

The pin 24 is somewhat similar to the pin of the first embodiment, having a slanting surface 27 which slopes transversely from a wedge portion 53 which slopes only in a longitudinal direction. The pin has walls forming a shallow slot 54 in its upper surface, and the resilience of the fingers 50 urges the pin 24 upwardly so that the retaining block 11 interlocks in the slot 54 to prevent inadvertent removal of the pin 24. Removal can then be effected only by means of a tool, and a suitable tool is briefly described in our companion U.S. application Ser. No. 055904.

Another form of "vandal proof" pin 24 is shown in FIG. 9. Once again this pin is provided with a slanting surface 27 which slopes transversely from a wedge portion 53 which slopes only longitudinally. The wedge portion 53 terminates in a flat land 56 beyond which exists a shoulder 57, while a recess 58 on the underside of the pin accommodates one of the fingers 50 and prevents movement of the pin in a reverse direction until such time as the fingers 50 have been deflected, by the tool mentioned above.

A consideration of the above embodiments will indicate the invention provides a number of advantages.

Firstly, the assembly is relatively small and occupies little space. Secondly, tolerance difficulties are overcome by the excellent spring rate which can be achieved by utilising a U-shaped spring steel bar. The spring rate is still further improved by the resilience of the bifurcate ends, and the locating aperture or apertures. The fastener clip is positively located by the retaining block against movement upon rail creep. In all instances, rail overturn is inhibited by the lower leg becoming contiguous with the upper leg, thereby stiffening the rail fastener assembly. The cam end on the locking pin enables the pin to slide over the fastener clip with a good surface to surface contact unlikely to damage the fastener clip surface. In some instances the clip can be reversed for varying the relative location of the rail and retaining blocks.

The form of the highly stressed heel is such that the tensile stresses are minimised, at the expense of compressive stresses. This feature is significant in respect of both stress corrosion and spring rate.

What is claimed is:

1. A rail fastener for fastening a rail to a steel rail support, comprising:

a rectangular section retaining block adapted to be stud welded to the rail support and upstanding therefrom with the longitudinal axis of the retaining block positioned perpendicular to the longitudinal axis of the rail;

an aperture extending through the retaining block transverse to the longitudinal axis thereof and in the same direction as the longitudinal axis of the rail, the aperture including two side walls, a lower wall and an upper wall;

a resilient fastener clip having a back portion, an upper leg having an upper surface and bifurcated at one end to define a first pair of toes and interconnected to the back portion at its opposite end by a first heel portion, a lower leg bifurcated at one end to define a second pair of toes at one end and interconnected to the back portion at its opposite end by a second heel;

a rectangular locating aperture of dimension complementary to the rectangular section retaining block formed in at least one of the legs of the resilient fastener clip, the longitudinal dimension of which extends parallel to the longitudinal axis of the leg and adapted to receive the retaining block to locate the fastener clip with respect to the retaining block to inhibit both relative rotational and translational movement of the fastener clip relative to the retaining block;

the angulation of the first and second heels in their interconnection with the back portion and with the first and second legs being such that, when the clip is in place upon the retaining block and the second pair of toes of the second leg being in contact with the rail and the second heel of the second leg being in contact with the rail support, the first leg of the retaining clip will extend above the bottom wall of the aperture within the retaining block and at an angle inclined to the perpendicular axis of the retaining block when at rest; and a retaining pin adapted to extend through the aperture in contact with the upper surface of the upper leg and the upper wall of the aperture to apply a resultant downward force upon the upper leg of the clip with the retaining pin is in place within the aperture to thereby stress the clip and apply downward pressure of the second pair of toes upon the rail and second heel upon the rail support to secure the rail in place.

2. The rail fastener of claim 1 wherein the retaining pin has a wedge portion sloping only longitudinally of the pin and a slanting surface extending along the wedge portion and slanting only transversely of the retaining pin at an angle approximately the angle of the upper leg of the clip with respect to the perpendicular axis of the retaining block to facilitate entry of the pin into the aperture of the retaining block between the upper wall of the aperture and the upper surface of the upper leg during assembly of the rail fastener.

3. The rail fastener of either claims 1 or 2 wherein the retaining pin includes at least one vertical surface providing an interlock with either the retaining block or the upper leg of the clip to prevent withdrawal of the retaining pin unless the upper leg of the clip is depressed.

4. The rail fastener of either claims 1 or 2 wherein each respective upper and lower leg of the clip has a deformed portion which defines a bearing edge adapted to bear against the rail foot, the legs being of unequal length such that, upon inverting of the clip, the distance between the retaining block and the bearing edge of a given leg is varied.

5. The rail fastener of either claims 1 or 2 wherein the upper leg of the fastener clip overlies the lower leg thereof and in close proximity thereto when in assembled position such that, upon lifting of the lower leg by the rail foot, the lower leg engages the upper leg increasing the stiffness of the fastener clip thereby inhibiting rail overturn.

6. A rail fastener for fastening a rail to a steel rail support, comprising:

a rectangular section retaining block adapted to be stud welded to the rail support and upstanding therefrom with the longitudinal axis of the retaining block positioned perpendicular to the longitudinal axis of the rail;

an aperture extending through the retaining block transverse to the longitudinal axis thereof and in the same direction as the longitudinal axis of the rail, the aperture including two side walls, a lower wall and an upper wall;

a resilent fastener clip having a back portion, an upper leg having an upper surface and bifurcated at one end to define a first pair of toes and interconnected to the back portion at its opposite end by a first heel portion, a lower leg defining a toe at one end and interconnected to the back portion at its opposite end by a second heel;

a rectangular locating aperture of dimension complementary to the rectangular section retaining block formed in at least one of the legs of the resilient fastener clip, the longitudinal dimension of which extends parallel to the longitudinal axis of the leg and adapted to receive the retaining block to locate the fastener clip with respect to the retaining block to inhibit both relative rotational and translational movement of the fastener clip relative to the retaining block;

the angulation of the first and second heels in their interconnection with the back portion and with the first and second legs being such that, when the clip is in place upon the retaining block and at rest, and the second heel of the second leg is in contact with the rail and the toe of the second leg is in contact with the rail support, the first leg of the retaining clip will extend above the bottom wall of the aperture within the retaining block and at an angle inclined to the perpendicular axis of the retaining block; and a retaining pin adapted to extend through the aperture in contact with the upper surface of the upper leg and the upper wall of the aperture to apply a resultant downward force upon the upper leg of the clip when the retaining pin is in place within the aperture to thereby stress the clip and apply downward pressure on the second heel upon the rail and toe upon the rail support to secure the rail in place.

7. The rail fastener of claim 6 wherein the retaining pin has a wedge portion sloping only longitudinally of the pin and a slanting surface extending along the wedge portion and slanting only transversely of the retaining pin at an angle approximating the angle of the upper leg of the clip with respect to the perpendicular axis of the retaining block to facilitate entry of the pin into the aperture of the retaining block between the upper wall of the aperture and upper surface of the upper leg during assembly of the rail fastener.

8. The rail fastener of either claims 6 or 7 wherein the retaining pin includes at least one vertical surface providing an interlock with either the retaining block or the upper leg of the clip when the retaining pin is in place to prevent withdrawal of the retaining pin unless the upper leg of the clip is depressed.

* * * * *